US006672124B2

(12) United States Patent
Minnerop et al.

(10) Patent No.: US 6,672,124 B2
(45) Date of Patent: Jan. 6, 2004

(54) ROLLING MILL TRAIN WITH STAGGERED MILLS, ESPECIALLY AS A TANDEM ROLLING INSTALLATION

(75) Inventors: Michael Minnerop, Ratingen (DE); Hans-Jürgen Reismann, Düsseldorf (DE); Thomas Kosak, Neuss (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/056,344

(22) Filed: Jan. 25, 2002

(65) Prior Publication Data

US 2002/0108424 A1 Aug. 15, 2002

(30) Foreign Application Priority Data

Jan. 27, 2001 (DE) ..... 101 03 686

(51) Int. Cl.[7] ..... B21B 31/08
(52) U.S. Cl. ..... 72/239
(58) Field of Search ..... 72/239, 234, 237, 72/226

(56) References Cited

U.S. PATENT DOCUMENTS 4,038,857 A * 8/1977 Eibe et al. ..... 72/244
4,821,550 A * 4/1989 DeBarea, Sr. ..... 72/181
5,941,115 A * 8/1999 Minnerop et al. ..... 72/238
5,979,206 A 11/1999 Minnerop

FOREIGN PATENT DOCUMENTS

EP 0 857 521 8/1998

* cited by examiner

*Primary Examiner*—Allen Ostrager
*Assistant Examiner*—John S. Goetz
(74) *Attorney, Agent, or Firm*—Herbert Dubno

(57) ABSTRACT

A rolling roll train of the staggered-roll tandem type has a pair of upright stand walls with windows or openings for receiving a multiplicity of pairs of rolls which can be changed as a unit. The fact that unitary walls with traverses between the walls for stabilizing them and where those traverses are located between the roll pairs, enables the spacing between the roll pairs to be substantially reduced by comparison with free-standing individual mill stands for the roll pairs.

18 Claims, 2 Drawing Sheets

ROLLING MILL TRAIN WITH STAGGERED MILLS, ESPECIALLY AS A TANDEM ROLLING INSTALLATION

FIELD OF THE INVENTION

Our present invention relates to a rolling mill train with staggered (stepped-gap) mills, especially utilizing a tandem rolling configuration and wherein on both sides of the rolling line, mill stand walls are provided in windows of which the mill rolls are journaled in bearing chocks serving as bearing mounts and such that the mill rolls and their bearing mounts can be withdrawn from and replaced in the windows for roll replacement.

BACKGROUND OF THE INVENTION

A tandem rolling system is described in EP 0 857 521 and the corresponding U.S. Pat. No. 5,979,206. That rolling train may also be referred to as a staggered-mill rolling train. The individual rolling stands of the tandem group or similar staggered mill stands for reversing or continuous operation are provided as individual stand units, each with a pair of mill rolls mounted in two stand walls and having respective traverses connecting the mill walls.

Because each pair of rolls is received in a respective pair of mill walls with respective traverses, the overall length of the rolling train must be a function of the number of mill stands provided, any spacing between the mill stands and the dimensions of the mill stands assigned to the individual pairs of rolls.

It is, of course, desirable to make the length of the rolling train as short as possible since relatively long rolling mill trains are associated with a variety of drawbacks. For example, the armatures which may be necessary to guide the rolled workpieces between the pairs of rolls frequently must be long. The passage of the workpieces across the spacings between the rolls is considerable and the productivity, in terms of output per unit time, can be limited.

The intervals between reversals can be significant in the case of reversing mills and high precision in the control of the speed is necessary for both continuous reversing mills where the spacings between the roll pairs are considerable. In most cases the roll changing procedures are time-consuming and when the duration of such procedures is multiplied by the number of mill stands and roll units which must be replaced, the down time of the rolling train can be considerable. Finally, the cost of the equipment required for the roll change, the stand structures themselves and the guides required between stands can be considerable as well.

OBJECTS OF THE INVENTION

It is, therefore, the principal object of the present invention to provide a staggered rolling train or tandem rolling train of the type described in the aforementioned patent, wherein, however, the capital and equipment cost can be reduced, the productivity increased and the length of the rolling train limited.

Another object of the invention is to provide an improved rolling train whereby drawbacks of the earlier systems can be avoided.

SUMMARY OF THE INVENTION

These objects are achieved, in accordance with the invention in a rolling train in which a workpiece traveling along a rolling line is rolled in succession between opposing mill rolls of a succession of pairs thereof, the mill train having at least one mill stand which comprises:

- a pair of unitary stand walls spaced from the mill line on a drive side and a service side of the mill stand respectively, each of the stand walls having a plurality of stand windows spaced apart along the line and in a direction of rolling of the workpiece;
- respective pairs of the mill rolls having bearing chocks received in corresponding ones of the windows of the pair of stand walls and journaling the respective mill rolls therein, the pairs of mill rolls and the respective bearing chocks being removable from and replaceable in the corresponding windows of the stand walls on the drive and service sides of the stand for roll replacement; and
- respective intermediate traverses extending transversely to the direction and interconnecting the unitary walls between successive ones of the pairs of rolls and locking the stand walls together.

According to the invention, that mill stand can be incorporated in a staggered mill line or tandem rolling plant of the type described in the aforementioned patent.

According to this invention, a stand for a multiplicity, preferably at least three pairs of mill rolls spaced along the rolling line can be mounted in unitary stand walls on opposite sides of the rolling line and each of which is provided with a plurality of windows receiving respective pairs of rolls and their bearing mounting pieces, i.e. the so-called bearing chocks. Instead of having such walls for each pair of rolls and traverses bracing the walls of the separate mill stands, the present invention provides common intermediate traverses between the pairs of rolls of a single mill stand having unitary stand walls for a multiplicity of roll pairs, the intermediate traverses securing the stand walls together.

This construction enables relatively small distances between the pairs of rolls and, indeed a spacing between the pairs of rolls which can be a small fraction of the spacing which hitherto was required when each such pair of rolls was mounted in a separate stand.

As a result, the rolling and reversal times are significantly shorter. The distance over which the workpieces must be guided by rolling armatures between rolls can be significantly shorter and can be formed in one piece, thereby creating a cost saving. Furthermore, the system is of greater operational reliability and often a better rolling quality because shorter distances between successive pairs of rolls which must be bridged by the workpiece.

We have found that especially in the fabrication of H-section structural shapes, there is an improvement in the uniformity of the product and a reduction of off-centering of the flanges, for example.

Because the stand walls are common to a multiplicity of pairs of rolls, many individual operations can be eliminated or operations such as roll change can be effected for groups of rolls simultaneously and structural simplicity can be gained by eliminating additional traverses or the like as may be necessary by comparison with roll stands individual to the pairs of rolls.

In so-called duo stands which have hitherto required four tension anchors, traverses, clamping nuts and hydraulically actuated clamping wedges, numerous sole plates and hydraulic actuators and clamping devices and separate medium fittings for supplying the hydraulic medium, all of these duplicated elements can be eliminated in whole or in part by the common supply of hydraulic fluid to all of the actuators for the three or more roll pairs and the use of traverses between the roll pairs and thus common thereto.

According to a feature of the invention, at the ends of the stand walls in the direction of the rolling line, respective base plate clamping devices are provided. With the system of the invention, using such base plate clamping devices at the ends of each unitary wall, the greater number of base plates and respective clamps which would have been needed for a multiple wall system in the case of separate stands for each pair of rolls, can be eliminated.

The hydraulic fluid medium feed for the hydraulic actuators of the rolls can be provided with a single hydraulic medium network which can extend between the service side and the drive side walls. While reference is made here to at least one medium network, it will be understood that only one may be required. The single medium supply fitting can be provided for all of the actuators of the rolls mounted in the two walls. Separate medium networks and medium columns or fittings for each pair of rolls can be avoided.

A further simplification in accordance with the invention provides that between two neighboring roll pairs mounted on two walls of the invention, a common roll armature is provided. This armature can be significantly shorter than the roll armatures used to guide workpieces heretofore and can even be formed in one piece, thereby guiding the workpiece with high reliability and reducing the length of free space which would have to be bridged by the rolled workpiece between the roll pairs. This, of course, ensures a better rolling quality.

The common roll armature can be fixed on a roll beam which is disposed centrally between roll pairs of the multiple pair stand of the invention. As a consequence, additional roll guide devices and holding brackets which may be required where intermediate rolling stands are provided between main rolling stands, can be eliminated. The capital cost is greatly reduced, the span occupied by the number of roll pairs included in the two walls is reduced and operating costs are likewise reduced.

Since the stand walls are formed each in one piece, the retraction of a retractable stand wall is greatly simplified. According to the invention, the stand wall on the service side of the mill can be retracted, e.g. by an actuator such as a long hydraulic cylinder and the set of roll pairs mounted in the stand walls can be retracted in a similar direction onto a single carriage for the entire roll unit. The traverse connections can be opened, in that case, as can clamping devices at the base plates to enable the retraction of the service side wall. Alternatively, the roll pairs can be displaced by respective hydraulic cylinders onto one or more such carriages and the carriage or carriages can carry the rolls to be replaced away from the mill stand in a direction perpendicular to the retraction direction. A crane can be used for this purpose, as well. The replacement rolls, roll pairs or set or units of multiple roll pairs can be brought into line with the openings in the stand walls by the carriage or crane and the retractable wall can be replaced in its original position and locked to the traverses and the base plate.

It has been found to be advantageous to provide the roll pairs so that they are replaceable with the roll armatures and such that all of the roll pairs in the stand can be transported to the stand and away from the stand on a single carriage.

The roll pairs can be driven by meshing wheel transmissions which can be provided in a common housing for all roll pairs and the control for individual roll pairs can remain unaffected.

Upon a roll replacement and the retraction of the service side stand wall, the actuator or hydraulic cylinder should have a greater length than is required for extraction of the roll unit or set.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
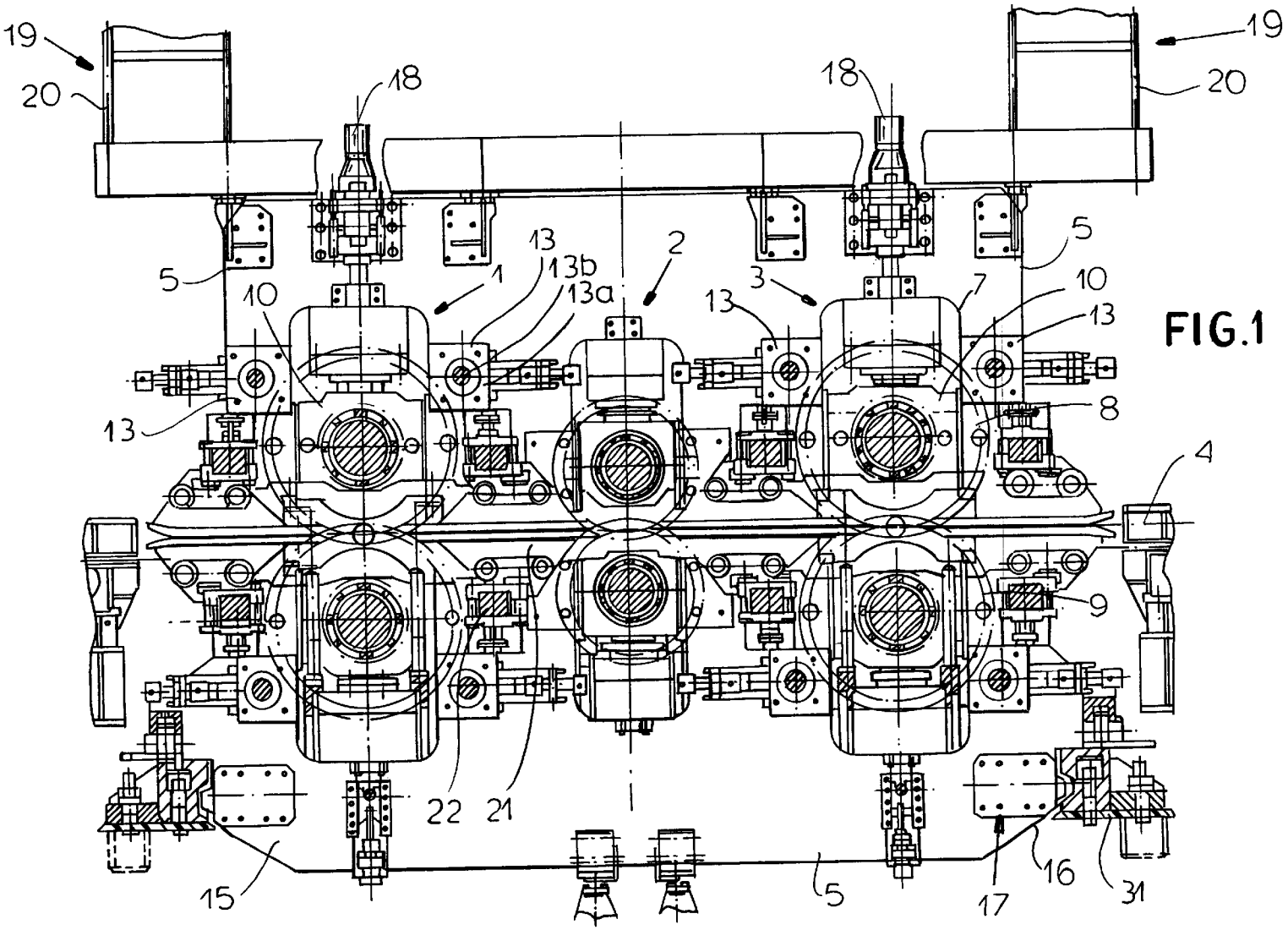
FIG. 1 is an axial longitudinal section along a rolling line through a stand according to the invention, of a staggered rolling mill system.
Figure 2:
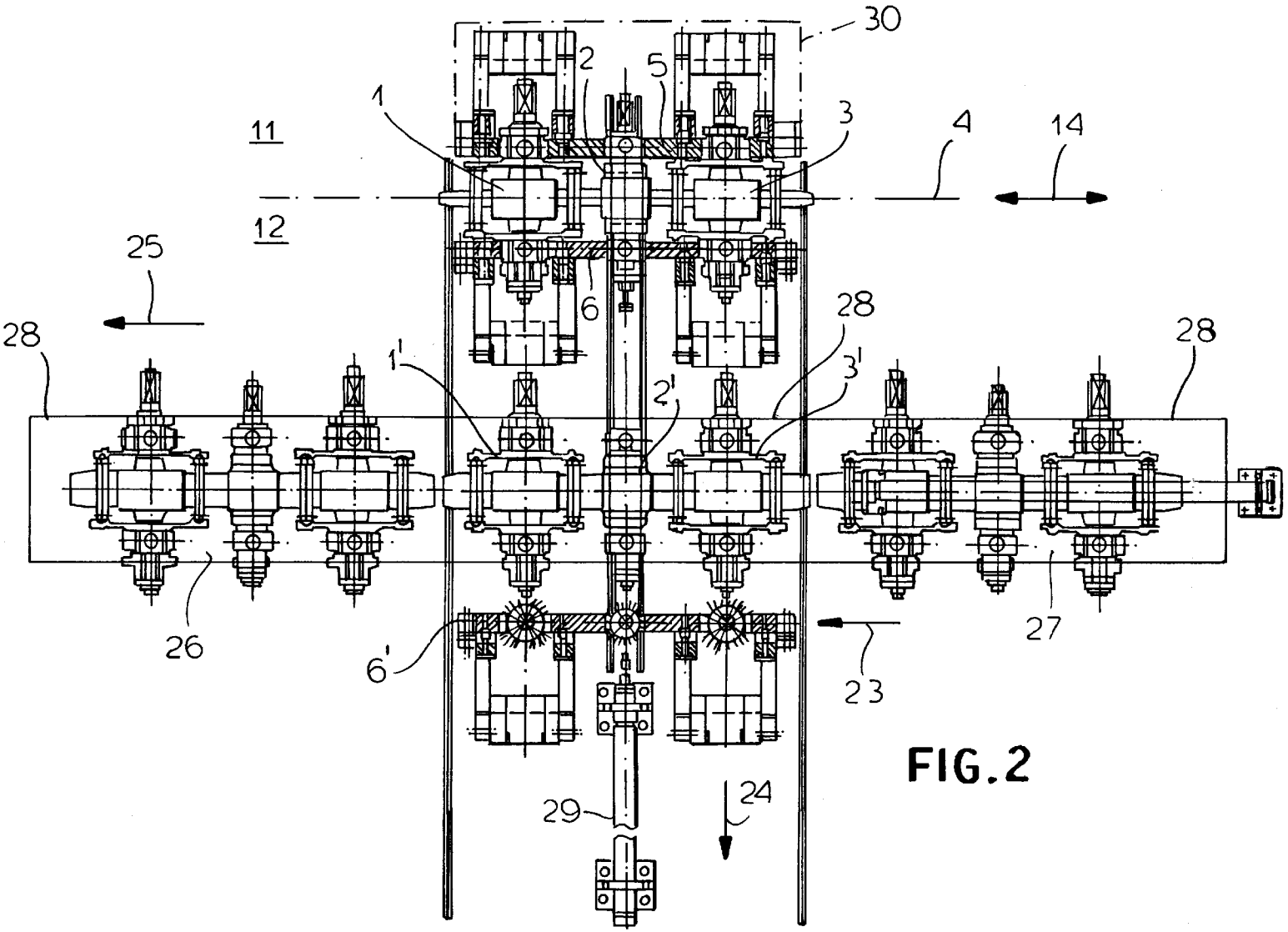
FIG. 2 is a plan view of a corresponding portion of the roll mill.

The rolling line shown in FIGS. 1 and 2, intended for use in a manner similar to the rolling train of U.S. Pat. No. 5,979,206 and referred to there as a tandem stand line with three staggered roll pairs 1, 2 and 3 which, in the embodiment shown, are provided in a single stand. As with staggered roll pairs generally, the roll pairs here are designed in an echelon-type or graded reduction sequence so that they also form a tandem rolling system.

To both sides of the rolling line 4 (FIGS. 1 and 2) respective unitary stand walls 5 and 6 are provided with stand windows for openings 7 in which the rolls 8 and 9 of each roll pairs 1, 2, 3 are mounted via their respective mounting pieces or bearing chucks 10 and in which the rolls of each pair are adjustable. Thus in each of the stand walls 5 and 6 of the invention there are a multiplicity of such windows 7 for the analogous number of bearing chucks 10 and one of the unitary stand walls 5 is located on the drive side 11 of the rolling line and the other unitary stand wall 6 is located on the service side 12 thereof. The mechanisms for driving the rolls are, of course, located on the drive side 11 of the mill while the mechanisms for roll replacement, roll withdrawal and roll exchange are provided on the service side 12. The stand walls 5 and 6 are interconnected via intermediate traverses 13 which, at least at one of the stand walls can include locking devices 13*a* which can releasably engage the respective bar 13*b* extending across to the other wall so that, upon release of the lock, at least the stand wall 6 can be retracted into the position shown at 6' in FIG. 2 and as will be described in greater detail hereinafter.

The roll pairs are provided with hydraulic positioning drives 18 which for the three roll pairs shown in FIGS. 1 and 2 can have a hydraulic medium feed 19 with a respective medium chain 20 running between the drive side 11 and the service side 12. The number of fittings for the hydraulic actuators 18 and used to connect the hydraulic medium to it can be reduced from the number required for three discrete roll stands of the type hitherto necessary for three such pairs of rolls.

Between each two neighboring roll pairs 1, 2 and 2, 3, there are respective common roll armatures 21 which are affixed to respective roll beams located approximately centrally between the roll pairs 1, 2 and 2, 3 respectively.

As can be seen from FIG. 2, when a stand wall 6 is retracted from its operating position as shown at the top of FIG. 2 into its retracted position shown at 6' in this Figure, at the service side 12, the roll pairs 1, 2, 3 can similarly be extracted from the remaining wall 5 in the same direction 24 and deposited upon a single carriage 26 for each multiroll unit and displaced perpendicular to the direction 24 in the roll change direction represented by the arrow 25. The previously worn and removed roll set is shown at 26, the retracted roll set is shown at 1', 2', 3' and a new roll set is shown at 27 in readiness for insertion into the mill. The rolling direction is represented by the double-headed arrow 19 illustrated in FIG. 2 and each roll set or unit is transported by a single roll change carriage 28.

The rotary drive for all the rolls of each pair can be a meshing tooth transmission which can be received in a common housing not shown in detail but represented in dot-dash lines at 30 in FIG. 2. For the retractable stand wall 6, the service side 12 of the mill can have a much longer retraction cylinder 29 for hydraulic displacement of the retractable wall than is normally used to withdraw and replace a roll from a single roll pair mill.

It will be understood that for displacement of the walls 5, 6 units, clamping devices 17 at the ends 15 and 16 of the stand walls 5 and 6 in the rolling line direction 14 must be released to disengage the walls from the respective base plates 31 and, of course, the locks 13*a* for the traverses 13 must similarly be released. When the walls are brought back into the rolling position, however, the clamp 17 and the locks 13*a* are reengaged.

We claim:

1. A rolling mill train in which a workpiece traveling along a rolling line is rolled in succession between opposing mill rolls of a succession of pairs thereof, said rolling mill train having at least one mill stand comprising:

a pair of unitary stand walls spaced from said mill line on a drive side and a service side of said mill stand respectively, each of said stand walls having a plurality of stand windows spaced apart along said line and in a direction of rolling of said workpiece;

respective pairs of said mill rolls having bearing chocks received in corresponding windows of said pair of stand walls and journaling the respective mill rolls therein, said pairs of mill rolls and the respective bearing chocks being removable from and replaceable in said corresponding windows of the stand walls on the drive and service sides of the stand for roll replacement, said pairs of mill rolls being spaced in said direction and said walls being common to all of the pairs of said succession; and respective intermediate traverses extending transversely to said direction and interconnecting said unitary walls between successive pairs of rolls and locking said stand walls together.

2. The rolling mill train defined in claim 1, further comprising base-plate clamping devices securing bottoms of said walls at each end thereof in said direction.

3. The rolling mill train defined in claim 2, further comprising at least one hydraulic medium network connecting the drive and service sides, respective hydraulic positioners for said pairs of rolls, and at least one hydraulic medium supply fitting for each of said hydraulic positioners and communicating with said hydraulic medium network.

4. The rolling mill train defined in claim 3, further comprising a roll armature common to and located between two of said pairs of rolls.

5. The rolling mill train defined in claim 4 wherein said roll armature is mounted on a beam midway between two successive roll pairs along said rolling line.

6. The rolling mill train defined in claim 5, further comprising an actuator for retracting said wall at said service side away from said rolling line in a retraction direction into a retracted position, and a roll carriage receiving roll pairs removed from said walls and displacing the removed roll pairs in a direction perpendicular to said retraction direction.

7. The rolling mill train defined in claim 6 wherein all of said roll pairs and respective roll armatures are replaceable in said stand as a unit.

8. The rolling mill train defined in claim 7 wherein said unit is transported away from said stand on a single carriage.

9. The rolling mill train defined in claim 8, further comprising a drive for the rolls of said stand including a meshing-wheel transmission in a common housing for said roll pairs.

10. The rolling mill train defined in claim 9 wherein said actuator is a long retraction cylinder on said service side.

11. The rolling mill train defined in claim 1, further comprising at least one hydraulic medium network connecting the drive and service sides, respective hydraulic positioners for said pairs of rolls, and at least one hydraulic medium supply fitting for each of said hydraulic positioners and communicating with said hydraulic medium network.

12. The rolling mill train defined in claim 1, further comprising a roll armature common to and located between two of said pairs of rolls.

13. The rolling mill train defined in claim 12 wherein said roll armature is mounted on a beam midway between two successive roll pairs along said rolling line.

14. The rolling mill train defined in claim 1, further comprising an actuator for retracting said wall at said service side away from said rolling line in a retraction direction into a retracted position, and at least one roll carriage receiving roll pairs removed from said walls and displacing the removed roll pairs in a direction perpendicular to said retraction direction.

15. The rolling mill train defined in claim 1, further comprising a roll armature common to and located between two of said pairs of rolls, all of said roll pairs and respective roll armatures being replaceable in said stand as a unit.

16. The rolling mill train defined in claim 15 wherein said unit is transported away from said stand on a single carriage.

17. The rolling mill train defined in claim 1, further comprising a drive for the rolls of said stand including a meshing-wheel transmission in a common housing for said roll pairs.

18. The rolling mill train defined in claim 1, further comprising a long hydraulic cylinder connected to said wall at said service side for retracting said wall at said service side away from said rolling line in a retraction direction into a retracted position, and a roll carriage receiving all of said roll pairs removed from said walls and displacing the removed roll pairs as a unit in a direction perpendicular to said retraction direction.

* * * * *